United States Patent [19]

Hughes et al.

[11] Patent Number: 4,721,227

[45] Date of Patent: Jan. 26, 1988

[54] FIRE-RESISTANT CONTAINER

[75] Inventors: John T. Hughes, Worcester; Michael Hardiman, Stourport-on-Severn, both of United Kingdom

[73] Assignee: Micropore International Limited, Droitwich, United Kingdom

[21] Appl. No.: 815,856

[22] Filed: Jan. 3, 1986

[30] Foreign Application Priority Data

Jan. 10, 1985 [GB] United Kingdom ..... 8500624

[51] Int. Cl.[4] ..... F27D 11/00

[52] U.S. Cl. ..... 220/429; 220/215; 220/469; 109/78; 109/80; 109/84

[58] Field of Search ..... 206/444, 387; 220/215, 220/426, 429, 469; 109/78, 80, 82, 84

[56] References Cited

U.S. PATENT DOCUMENTS

| | | | |
|---|---|---|---|
| 268,819 | 12/1882 | Nolan | 109/84 |
| 773,269 | 10/1904 | Vanderman | 109/84 |
| 858,583 | 7/1907 | Doan | 220/429 |
| 1,179,356 | 4/1916 | Hague | 220/429 |
| 1,719,868 | 7/1929 | Beverly | 220/429 |
| 2,295,103 | 9/1942 | Friedly | 220/429 |
| 2,514,696 | 7/1950 | Dube | 109/82 |
| 2,655,882 | 10/1953 | Tripp | 109/82 |
| 2,954,893 | 10/1960 | Sayre | 220/215 |
| 3,035,733 | 5/1962 | Knapp | 220/215 |
| 3,559,594 | 2/1971 | Miller | 220/429 |
| 3,603,106 | 9/1971 | Ryan | 220/429 |
| 3,606,066 | 9/1971 | Anderson | 220/469 |
| 3,613,872 | 10/1971 | Donnelly | 220/426 |
| 3,640,379 | 2/1972 | Weingarden | 206/387 |
| 3,888,557 | 6/1975 | Anderson et al. | 220/429 |
| 3,913,775 | 10/1975 | Ozaki | 220/429 |
| 3,916,804 | 11/1975 | Noone | 109/78 |
| 3,989,329 | 11/1976 | Benford | 220/429 |
| 4,263,365 | 4/1981 | Burgess et al. | 109/78 |
| 4,574,454 | 3/1986 | Dyson | 109/84 |

*Primary Examiner*—Stephen Marcus
*Assistant Examiner*—David T. Fidei
*Attorney, Agent, or Firm*—Browdy and Neimark

[57] ABSTRACT

A fire-resistant container for protecting magnetic media such as floppy discs comprises a base and a cover. The base is in the form of an outer casing and an inner container separated by thermal insulation material which is maintained under compressive stress so as to retain the inner container in position within the outer casing and to permit the insulation material to expand when the outer casing expands as a result of exposure to high temperature. The inner container may have a hollow wall which is filled with wax. The cover may comprise a dished outer cover, an inner cover and thermal insulation material which is maintained under compressive stress.

12 Claims, 2 Drawing Figures

FIRE-RESISTANT CONTAINER

FIELD OF THE INVENTION

The present invention relates to fire-resistant containers which are suitable for storing magnetic media such as so-called floppy discs for computers.

DESCRIPTION OF THE PRIOR ART

Many types of containers exist for storing papers and documents which are constructed to resist damage by fire. They may be in the form of safes, cabinets, boxes, drawers or the like, and are typically required to provide protection of their contents for a period of one hour. This means that after exposure to a fire condition as specified by various Approval Authorities the documents must be readable on recovery from the container.

The required performance is readily achieved in these known containers by inserting traditional insulations in combination with water-bearing cements between an inner container and an outer casing. Access in the form of a lid, drawer or cover is provided and the seal between the cover or the like and the remainder of the container is generally shaped as a stepped labyrinth to prevent the passage of infra-red heat or flame during a fire.

Such containers, while being adequate for the protection of paper, are not suitable for protecting floppy discs and other magnetic media. Whereas paper can be heated to about 200° C. before it is destroyed, the plastics compositions used for storing magnetic data are damaged at temperatures above about 60° C.

To provide protection for magnetic media it is necessary to have a much more efficient thermal insulating system so that many container designs which are suitable for storing papers have been adapted to protect magnetic media by putting into a normal storage space another container which is also insulated.

Designs such as these are unwieldy and expensive.

OBJECT OF THE INVENTION

It is an object of the present invention to provide a fire-resistant container which is lightweight and relatively inexpensive and which is able to withstand the normal fire specification used for document containers, but also to give protection to floppy discs and other magnetic media.

SUMMARY OF THE INVENTION

According to the present invention there is provided a container for protecting magnetic media from fire, which container comprises a base and a cover, the base comprising an outer casing and an inner container separated by thermal insulation material, wherein the thermal insulation material is maintained under compressive stress so as to maintain the inner container in position within the outer casing and to expand when the outer casing expands as a result of exposure to high temperature.

Such a container is small in size, relatively lightweight and inexpensive and thus is of considerable benefit to people who may wish to move floppy discs for computers from place to place and to have such floppy discs protected at all times from damage by fire.

For a better understanding of the present invention and to show more clearly how it may be carried into effect reference will be made, by way of example, to the accompanying drawings in which:

DESCRIPTION OF PREFERRED EMBODIMENT

The figures show a fire-resistant container which comprises an outer casing 1 which is made from a material which is able to withstand exposure to fire for a period of one hour without serious deterioration. A further requirement is that the material must be able to withstand impacts which may be sustained when a building in which the container resides collapses as a result of fire. We have found that mild steel having a thickness of 1 mm is suitable.

Figure 1:
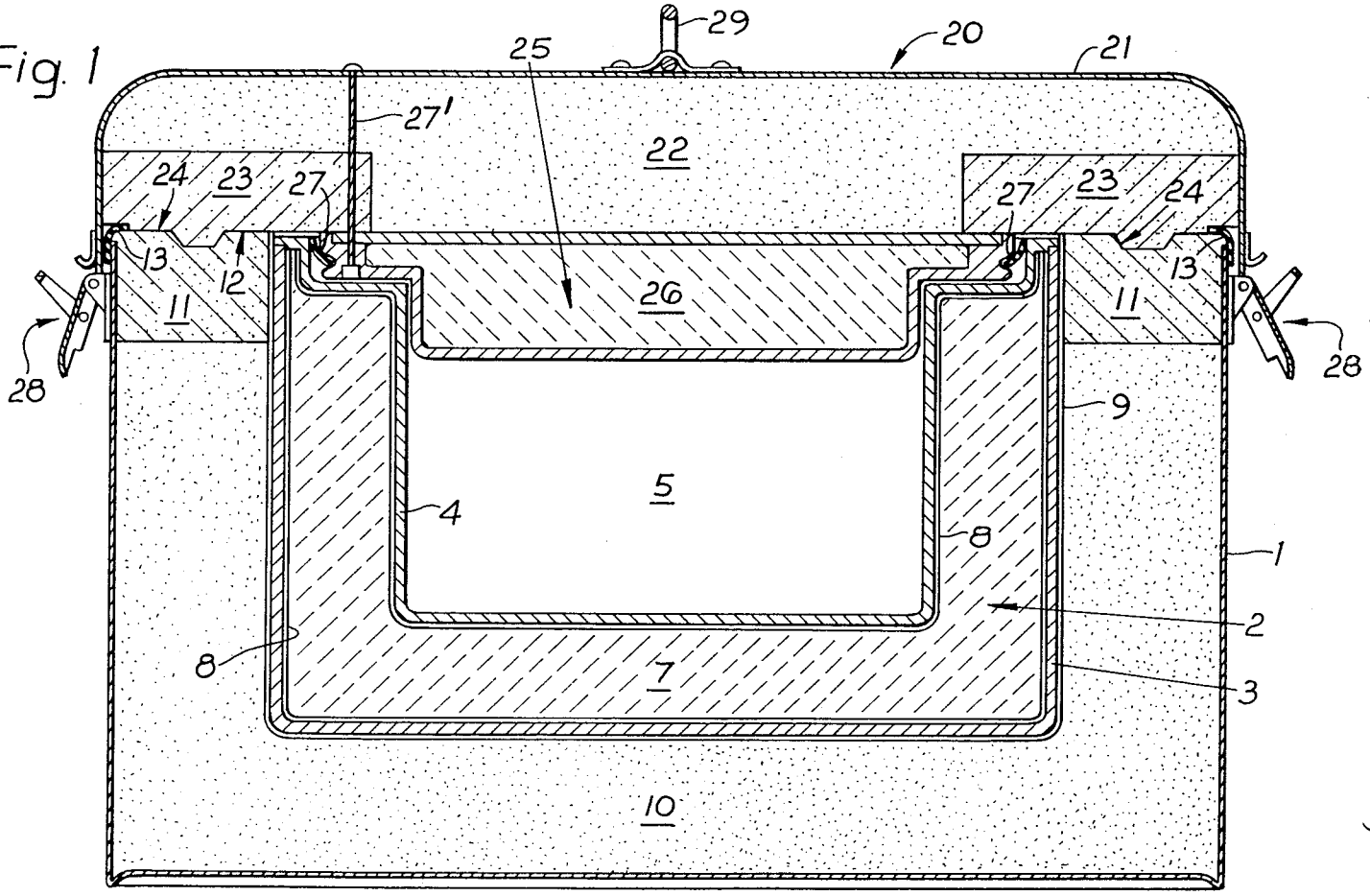
FIG. 1 is a cross-sectional view through a fire-resistant container according to the present invention.
Figure 2:
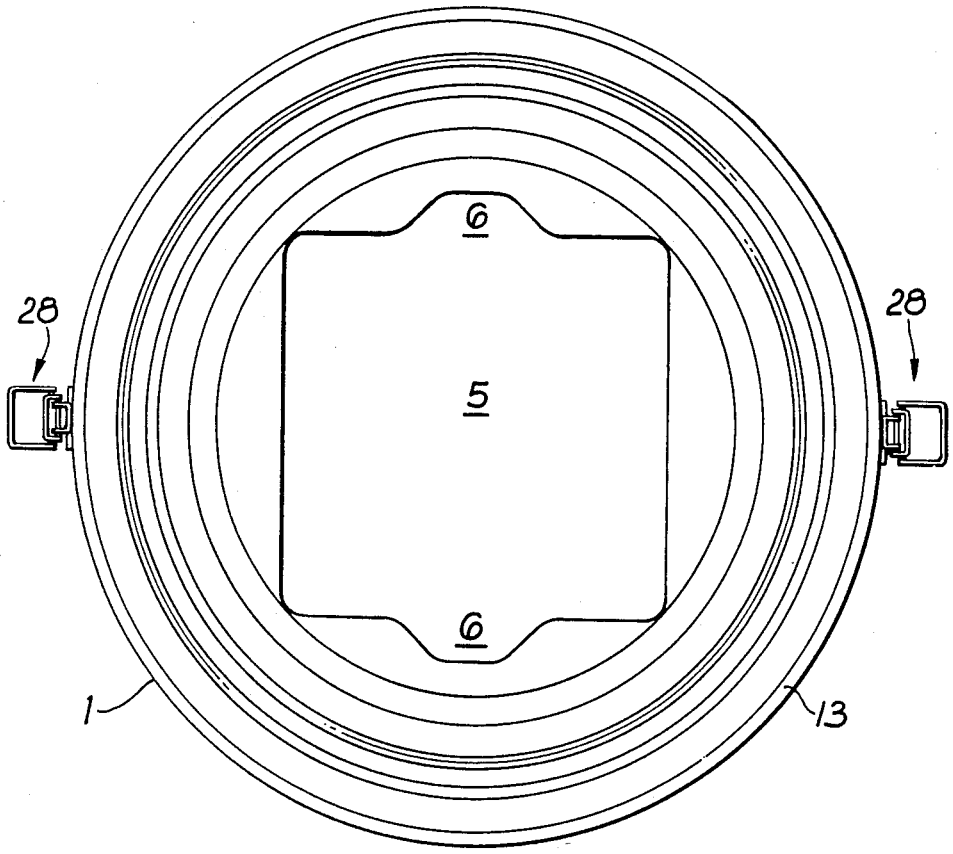
FIG. 2 is a plan view of the container shown in FIG. 1 with the cover removed.

Within the outer casing 1 and spaced therefrom is a hollow chamber 2 which has an outer wall 3 and an inner wall 4, the inner wall defining a storage cavity 5 which in the illustrated embodiment is capable of storing two library boxes each containing ten 5½ inch floppy discs. As can be seen from FIG. 2, the inner wall 4 in the illustrated embodiment is provided with recesses 6 to facilitate the insertion and removal of the library boxes of floppy discs (not shown).

The hollow chamber 2 is not expected to experience very high temperatures and may therefore be made from a wide range of materials including plastics and metals. However, it is preferable to use a material with a relatively high specific heat, such as a plastics material, so that for a given amount of heat flowing into the hollow chamber 2 the resulting temperature rise is relatively small.

The interior of the hollow chamber 2 is filled with a wax 7. The wax is chosen with a melting temperature of about 50° C. so that as it melts it absorbs substantial quantities of heat without a change in temperature. We have found that a paraffin wax with a specific heat of about 0.69 cals/gm and a latent heat of about 60 cals/gm is suitable. To establish uniformity of temperature within the hollow chamber 2 the inside surface of the chamber is covered with aluminium foil 8. The aluminium foil 8 conveniently has a self-adhesive backing.

The outer surface of the outer wall 3 is also covered with aluminium foil 9, which conveniently also has a self-adhesive backing, so as to guard against hot spots which could occur, especially around the rim of the container.

Between the outer casing 1 and the hollow chamber 2 there is disposed an insulation material 10. The insulation material 10 comprises a high-performance microporous insultation which typically comprises a mixture of a finely divided silica such as pyrogenic silica in a proportion of 50 to 80 per cent by weight, an infra-red opacifier, for example a metal oxide powder such as titania, quartz, chromia, ilmenite or iron oxide, or carbon black in a proportion of 20 to 50 per cent by weight and, optionally, a reinforcing fibre such as aluminosilicate fibre or alumina fibre in a proportion of 2 to 20 per cent by weight. The silica may be treated with a hydrophobing agent to prevent the presence of significant amounts of water in the insulation material.

It is a characteristic of the insulation material 10 that, when an intimate mixture of the components is compressed, the mixture becomes compacted to a solid when it is at a density above about 150 kg/m$^3$ and shaping may be achieved by compaction into a die. When the pressure of compaction is released and the shaped article removed from the die it expands and the volume is found to be larger than when it was compacted in the die. With normal methods of insulating fire-proof containers, thermal expansion of the outer casing allows gaps to be created within the insulation system. However, the use of the insulation material 10 described above eliminates this problem. The insulation material 10 is compacted into the space between the outer casing 1 and the hollow chamber 2 so that it remains under compressive stress even after the compaction pressure is released so that when thermal expansion of the outer casing 1 occurs the insulation material 10 can expand into the casing. Because the hollow chamber 2 is in position during the compaction the compressive stress within the insulation material causes it to be urged against the outer wall of the hollow chamber 2 thus holding the hollow chamber firmly in position even during severe handling of the container. Consequently, there is no need for any location fixings to connect the hollow chamber 2 with the outer casing 1 and this eliminates a significant potential source of heat conduction to the hollow chamber 2.

Superimposed on the insulation material 10 is an insulation insert 11 which is moulded or machined from relatively high density insulation material so as to form a mating face 12 for a cover which is described hereinafter. The axial thickness of the insulation insert 11 is as small as possible because the insert 11 may have little or no residual compression. The mating face 12 is coated with a suitable protective material such as a resin material.

The insulation material 10 and the insulation insert 11 are maintained under compressive stress by welding a retaining ring around the upper edge of the outer casing 1 while applying a compressive force to the mating face 12 of the insert 11. When the compressive force is removed, the retaining ring 13 maintains a compressive stress in the insulation.

The container is closed by a cover 20 which comprises a dished outer cover 21 which has compressed thereinto a layer of insulation material 22 which is substantially the same as the insulation material 10. Around the edge of the cover 20 there is an insulation insert 23 similar to the insulation insert 11. The insulation insert 23 is moulded or machined so as to form a mating face 24 which is complementary to the mating face 12. The mating faces 12 and 24 thus form a labyrinth seal between the cover 20 and the base of the container. The mating face 24 is also coated with a suitable protective material such as a resin material.

A hollow inner cover 25 may be made of the same material as the hollow chamber 2 and is filled with wax 26 in the same manner as the hollow chamber 2. The hollow inner cover 25 is generally disc-shaped so as to fit into a corresponding recess formed in the upper surface of the hollow chamber 2. However, a protrusion is formed on the disc so as to extend into the open mouth of the hollow chamber. A recess is formed around the rim of the hollow inner cover 25 so as to receive a seal 27 made of rubber or a similar elastomeric material.

The insulation material is moulded into the cover 20 in such a way that there is residual compressive stress within the insulation material so as to enable the insulation material to expand as the cover 20 expands on heating. The hollow inner cover 25 is firmly anchored to the insulation material by means of cords 27' which pass under tension through the hollow inner cover and the insulation material and are anchored to the cover 20. The cords 27' are few in number, for example there, and have low thermal conductivity because they have a small cross-sectional area and are preferably made of a relatively low thermal conductivity material. We have found that ordinary domestic string is adequate for this purpose and has the added advantage that when the container is exposed to heat the outer end of the string oxidises so that it no longer provides a heat conduction path.

The cover 20 may be secured to the base by means of any of a wide variety of suitable commercially-available fasteners such as lock fixtures or clips. However, we have found that toggle fasteners 28 are particularly suitable. However, toggle fasteners apply compression forces to the components that they secure together and it may be undesirable for any such forces to be applied to the mating faces of the thermal insulation materials. This problem can be overcome by causing the cover 20 to come to rest against stops which are positioned so as to allow only touching contact between the mating faces of the thermal insulation materials. In the illustrated embodiment this is accomplished by forming slots in the cover 20, the ends of which slots are dimensioned to bear against the toggle fastener when the cover is in the correct position.

A carrying handle 29 is provided on the top of the cover 20.

A fire-resistant container as described above is able to withstand fire conditions for an hour or more with a temperature rise within the storage cavity of no more than 30° C. The container has also been dropped from a height of over 9 meters when at a temperature of over 1000° C. and suffered only superficial damage to the casing at the point of impact.

We have used similar construction methods to produce shapes other than the round one shown. When a rectangular shape, for example, is made consideration must be given to the possibility of deflection of the side walls being caused by pressure from the insulation and some sort of reinforcement, ribbing or indentation may be desirable. We have also successfully moulded in situ the mating face profiles.

We claim:

1. A container for protecting magnetic media from fire, which container comprises a base and a cover, the base comprising an outer casing of fire and impact resistant material and an inner container defining a storage cavity for the magnetic media, the outer casing and the inner container being separated by thermal insulation material, wherein the thermal insulation material is maintained under compressive stress so as to provide the sole support for the inner container and to maintain the inner container firmly in position within the outer casing and to expand when the outer casing expands as a result of exposure to higher temperature, said thermal insulation material comprising a microporous material compacted to a density above 150 kg/m$^3$.

2. A container according to claim 1, wherein the inner container is formed with an inner wall and an outer wall defining therebetween a hollow chamber.

3. A container according to claim 2, wherein the hollow chamber of the inner container is filled with a wax.

4. A container according to claim 3, wherein the wax melts at a temperature of substantially 50° C.

5. A container according to claim 2, wherein the inner and outer walls of the inner container are lined with aluminum foil.

6. A container according to claim 1, wherein the outer surface of the inner container is covered with aluminium foil.

7. A container according to claim 1, wherein the inner container is provided with recesses to facilitate the insertion and removal of magnetic media.

8. A container according to claim 1 , wherein the thermal insulation material comprises a compacted particulate microporous thermal insulation material.

9. A container according to claim 1, wherein the cover comprises a dished outer member, an inner member and thermal insulation material which is maintained under compressive stress.

10. A container according to claim 9, wherein the inner member comprises an inner wall and an outer wall defining a hollow chamber therebetween.

11. A container according to claim 10, wherein the hollow chamber of the inner member is filled with a wax.

12. A container according to claim 9, wherein the inner member is shaped so as to protrude at least partly into the inner container.

* * * * *